United States Patent [19]

Pinto

[11] Patent Number: 4,845,892

[45] Date of Patent: Jul. 11, 1989

[54] DOOR PRIVACY SCREEN

[75] Inventor: Thomas J. Pinto, Bellevue, Wash.

[73] Assignee: Don Simmonds, Mercer Island, Wash.

[21] Appl. No.: 253,144

[22] Filed: Oct. 4, 1988

[51] Int. Cl.[4] ..... E06B 7/16

[52] U.S. Cl. ..... 49/383

[58] Field of Search ..... 49/383, 384; 160/229.1

[56] References Cited

U.S. PATENT DOCUMENTS

| | | | |
|---|---|---|---|
| 2,681,480 | 6/1954 | Dixon, Sr. | 49/383 |
| 3,319,697 | 5/1967 | Krohn | 49/383 X |
| 4,290,233 | 9/1981 | Hubbard | 49/383 |

FOREIGN PATENT DOCUMENTS

| | | | |
|---|---|---|---|
| 1437037 | 5/1976 | United Kingdom | 49/383 |

*Primary Examiner*—Philip C. Kannan

*Attorney, Agent, or Firm*—Christensen, O'Connor, Johnson & Kindness

[57] ABSTRACT

A door privacy screen including two strips (20 and 30) for blocking any line of sight through the space between the hinged-end surface (13) of a door (12) and the doorjamb (16). The first strip (20) is adhered to the hinged-end surface (13) of the door (12), and has a first portion (22) that extends beyond the door (12) in a direction orthogonal to the inside surface (14) of the door (12) substantially to the longitudinally central axis (42) of the door hinge (40). The second strip (30) is adhered to the doorjamb (16), and has a second portion (32) extending beyond the doorjamb (16) in a direction orthogonal to the inside surface (14) of the door (12) when the door (12) is in a closed position. The second portion (32) includes an arcuate portion (34) having a center of curvature coincident with the longitudinally central axis (42) of the door hinge (40). The first portion (22) and second portion (32) cooperatively overlap to block any line of sight.

13 Claims, 2 Drawing Sheets

Fig. 3.
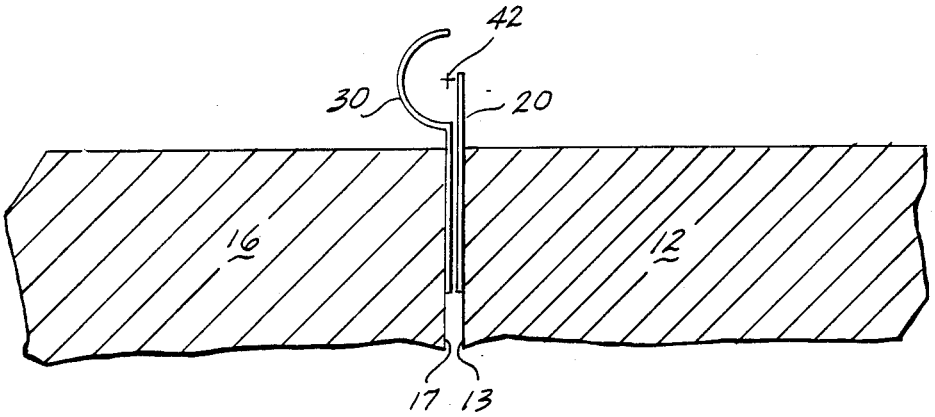
Fig. 4.
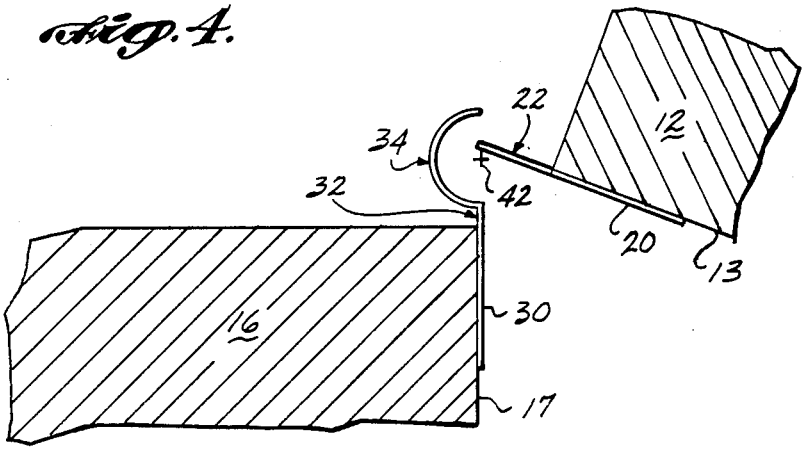
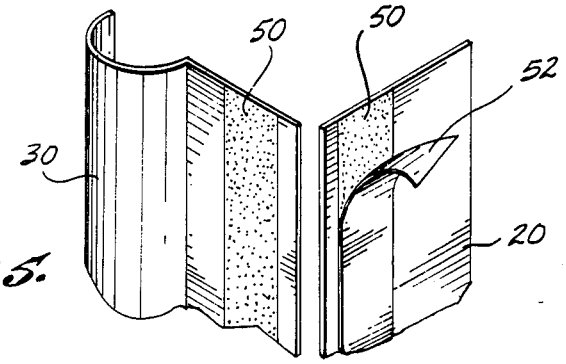
Fig. 5.

DOOR PRIVACY SCREEN

TECHNICAL AREA

This invention relates to door privacy screens and, more particularly, to screens for blocking any line of sight through the space formed between a doorjamb and a hinged end of a door when the door is opened.

BACKGROUND OF THE INVENTION

In many environments, it is desirable to prevent persons from viewing the inside of a room through the space between the hinged end of a door and the doorjamb. Occasionally, door hinges are designed such that there is a small crack, or space, between the hinged end of the door and the doorjamb even when the door is in a closed position. However, it is more often the case that the space between the hinged end of the door and the doorjamb is created as the door is moved to an open position.

An environment where privacy is of critical concern is that of the hospital or doctor's office setting. To this effect, many examination rooms are built with privacy doors. These are doors that are located near one of the extreme ends of the examination room, and have hinges mounted on the side of the door nearest the middle of the room. With this arrangement, the door opens to a view of the side wall of the examination room. Thus, as the door is opened to allow the doctor, nurse, or attendant to enter or leave, the patient and examination table are located behind the door. This door design also allows the door to be left slightly open, allowing those passing in the corridors only a partial view of the examination room side wall.

Nonetheless, even with a privacy door design, a visual line of sight into the examining room through the gap between the hinged end of the door and the doorjamb is provided whenever the door is in an open position. This exposure to passersby can cause the patient to feel discomfort, which often prevents the patient from relaxing and cooperating fully during examination and treatment. Consequently, the need for providing privacy at the junction of the hinged end of a door and a doorjamb is substantial.

Previous screening devices aimed at fulfilling this need have been complicated, expensive, or both. Among devices that are applied to existing door systems, many involve significant alternations to, or complete replacement of, the door and doorjamb. As a result, there has been a long-felt need for a simple, inexpensive door privacy screen that can easily be applied to existing door systems. This invention is directed to satisfying this need.

SUMMARY OF THE INVENTION

In accordance with this ivnention, a door privacy screen for blocking any line of sight through the space between the hinged end of a door and its associated doorjamb is disclosed. The door privacy screen includes two strips. The first strip is adhered to the hinged-end surface of a door, and has a first portion that extends beyond the door in a direction orthogonal to the inside surface of the door. The second strip is adhered to the doorjamb located adjacent to the hinged-end surface of the door when the door is in a closed position, and has a second portion extending beyond the doorjamb in a direction orthogonal to the inside surface of the door when the door is in a closed position. The first and second portions cooperatively overlap to block any line of sight through the space between the hinged-end surface of the door and the doorjamb while the door is in its closed or open positions and while the door is moved between the open and closed positions.

In a preferred embodiment of the invention, the first portion extends orthogonally outward from the inside surface of the door substantially to the longitudinally central axis of the door hinge. The second portion extending beyond the doorjamb includes an arcuate portion having its center of curvature coincident with the longitudinally central axis of the door hinge. Preferably, the arcuate portion extends through an arc of substantially 180°.

In accordance with other aspects of this invention, the first strip and the second strip are adhered to the hinged-end surface of the door and the doorjamb, respectively, through the use of double-sided tape running the length of each strip.

In accordance with still further aspects of this invention, the strips may be constructed in a manner that allows the first strip to be adhered to the doorjamb and the second strip to be adhered to the hinged-end surface of the door. In the preferred embodiment of the invention, this is accomplished by inverting the strips.

BRIEF DESCRIPTION OF THE DRAWINGS

The foregoing and other features and advantages of the present invention will become more readily appreciated as the same becomes better understood by reference to the following detailed description of a preferred embodiment of the invention and the accompanying drawings wherein:

FIG. 3 is a plan view in section of an assembled door privacy screen when the door is in a closed position;

FIG. 4 is a plan view in section of an assembled door privacy screen when the door is in an open position; and, FIG. 5 is a perspective view showing a mode of adhesion for the door privacy screen.

DESCRIPTION OF THE PREFERRED EMBODIMENT

Figure 1:
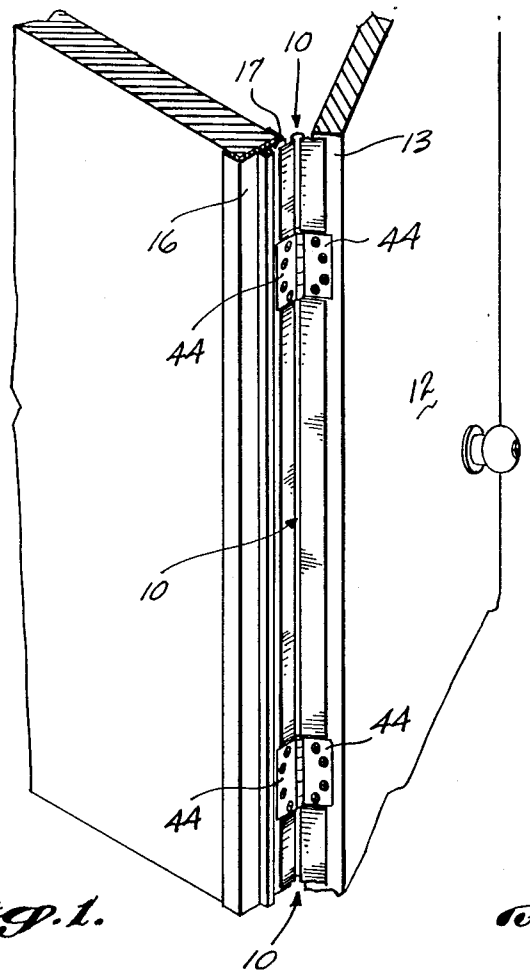
FIG. 1 is a perspective view of a door and wall portion with a door privacy screen formed in accordance with the invention in place.

FIG. 1 illustrates a preferred embodiment of a door privacy screen 10 formed in accordance with the invention. When in place, the door privacy screen 10 blocks any lines of sight through the space between the hinged end of a door 12 and a doorjamb 16. The door privacy screen 10 is adhered to the hinged-end surface 13 of the door 12 and to the doorjamb surface 17. The door privacy screen 10 runs the entire length of the hinged-end surface 13 of the door 12 and the doorjamb surface 17, except for those regions occupied by hinge attachments 44.

Figure 2:
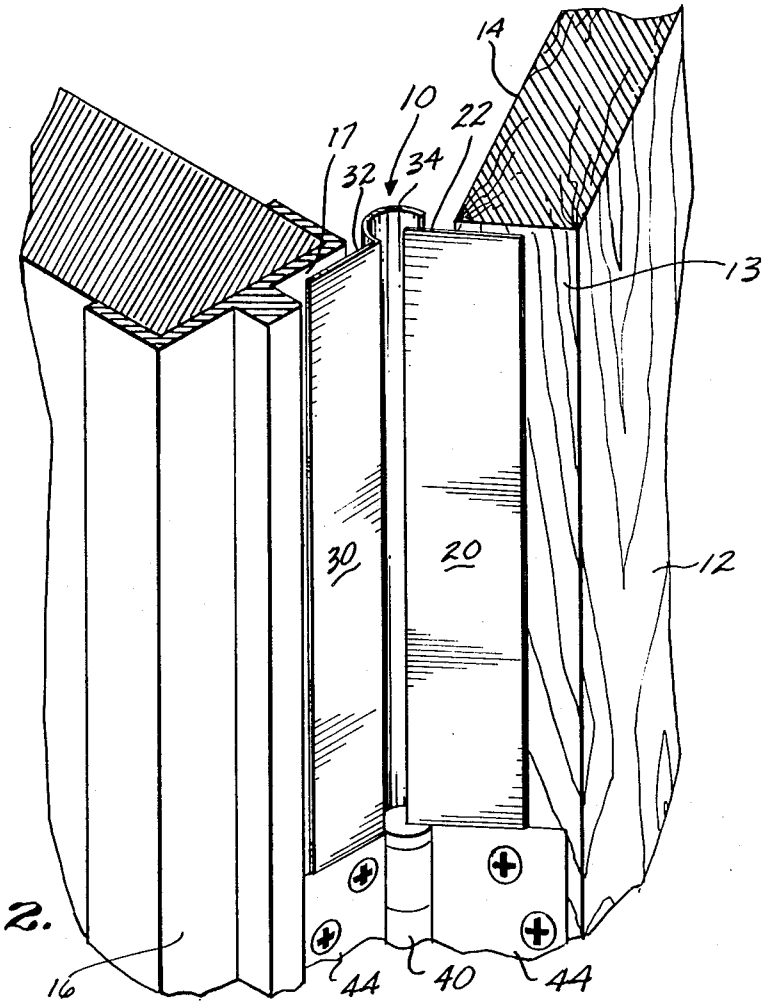
FIG. 2 is an enlarged view of a portion of FIG. 1.

As shown more clearly in FIGS. 2, 3 and 4, the door privacy screen 10 includes a first strip 20 and a second strip 30. The first strip 20 is adhered to the hinged-end surface 13 of the door 12, and has a first portion 22 that extends beyond the door 12 in a direction orthogonal to the inside surface 14 of the door 12. The first portion 22 extends substantially to the longitudinally central axis 42 of the door hinge 40. The second strip 30 is adhered to the doorjamb surface 17, which is located adjacent to the hinged-end surface 12 of the door 12 when the door 12 is in a closed position. The second strip 30 has a second portion 32 extending beyond the doorjamb 16 in a direction orthogonal to the inside surface 14 of the door 12 when the door is in a closed position. The second portion 32 extending beyond the doorjamb 16 includes an arcuate portion 34 having its center of curvature coincident with the longitudinally central axis 42 of the door hinge 40. Under this structural design, the first portion 22 and the second portion 32 cooperatively overlap to block any line of sight through the space between the hinged end of a door 12 and the doorjamb 16 while the door 12 is in an open position. This is best understood by reference to FIG. 4. It can also be appreciated from FIG. 3 that the first strip 20 and the second strip 30 serve to block any limited line of sight through the narrow space between the door 12 and the doorjamb 16 when the door is in a closed position.

The arcuate portion 34 of the second strip 30 extends through an arc of substantially 180°. An arc of substantially 180° is preferred because a shorter arc may leave an open space when the door 12 is initially opened, while a greater arc reduces the amount by which the door 12 may be opened. This restriction in opening occurs because the greater the arc, the sooner the first portion 22 will impinge upon the arcuate portion 34 as the door 12 is swung open from the closed position. This potential restriction in opening is best visualized by reference to FIGS. 3 and 4.

The first strip 20 is adhered to the hinged-end surface 13 of the door 12, and the second strip 30 is adhered to the doorjamb surface 17, through the use of double-sided tape 50 running the length of each of the strips 20 and 30 (refer to FIG. 5). One side of the double-sided tape 50 is adhered to the strips 20 and 30 and the other is covered with a protective backing 52 that is removed just prior to installation. The strips 20 and 30 are of a thickness that allows them to fit within the narrow space between the door 12 and the doorjamb 16 when the door is in a closed position, as shown in FIG. 3. The strips 20 and 30 are also of a thickness and material of construction that allow them to be cut with normal household cutting tools (i.e., scissors, carpet knives, hacksaws, etc.). This allows the strips 20 and 30 to be properly sized lengthwise with minimal effort. A preferred material of construction is a thermoplastic resin, such as rigid polyvinylchloride. Another preferred material of construction is any metallic substance capable of being formed into sheets thin enough to meet the above-mentioned cutting requirements, such as aluminum or roll-formed steel. These materials have the added advantage of being easily colored or textured to match the decor of the environment in which they are to be placed.

The strips 20 and 30 also have an interchangeability feature that allows the first strip 20 to be adhered to the doorjamb surface 17 and the second strip 30 to be adhered to the hinged-end surface 13 of the door 12. This is accomplished by inverting the strips 20 and 30.

While a preferred embodiment of the invention has been illustrated and described, it should be understood that variations can be made therein without departing from the spirit and scope of the invention. For example, any standard adhesive or mechanical means of attachment (i.e., glue, contact cement, nails, screws, staples, etc.) may be used to adhere the strips 20 and 30. Further, a witness mark (i.e., a mark used to help alignment) may be added to the strips 20 and 30 to aid installation. Accordingly, it is to be understood that the invention is not to be limited to the specific embodiment illustrated and described. Rather, the true scope and spirit of the invention is to be determined by reference to the following claims.

The embodiments of the invention in which an exclusive property or privilege is claimed are defined as follows:

1. A door privacy screen comprising:

a first strip adhered to a hinged-end surface of a door, said first strip having a first portion that extends beyond said door orthogonal to an inside surface of said door; and, a second strip adhered to a doorjamb located adjacent said hinged-end surface of said door when said door is in a closed position and having a second portion extending beyond said doorjamb, said first and second portions cooperatively overlapped when said door is moved from its closed position to an open position so as to block any line of sight through a space between said hinged-end surface of said door and said doorjamb.

2. The door privacy screen of claim 1, wherein said first portion extends substantially to a longitudinally central axis of a door hinge of said door.

3. The door privacy screen of claim 2, wherein said second portion includes an arcuate portion having a center of curvature coincident with said longitudinally central axis of said door hinge.

4. The door privacy screen of claim 3, wherein said arcuate portion extends through an arc of substantially 180°.

5. The door privacy screen of claim 1, wherein said first strip and said second strip are of a material of construction and of a thickness that allow for proper sizing with manually operable cutting means.

6. The door privacy screen of claim 5, wherein said material of construction is a thermoplastic resin.

7. The door privacy screen of claim 6, wherein said thermoplastic resin is rigid polyvinyl chloride.

8. The door privacy screen of claim 5, wherein said material of construction is aluminum.

9. The door privacy screen of claim 5, wherein said material of construction is roll-formed steel.

10. The door privacy screen of claim 1, wherein said first strip and said second strip are adhered to said hinged-end surface of said door and said doorjamb respectively through use of double-sided tape running the length of each of said first and second strips.

11. The door privacy screen of claim 1, wherein said first strip and said second strip run the entire length of said hinged-end surface of said door and said doorjamb respectively exclusive of a hinge attachment region associated with a door hinge of said door.

12. The door privacy screen of claim 1, wherein said first portion includes an arcuate portion having a center of curvature coincident with a longitudinally central axis of a door hinge of said door and said second portion extends substantially to said longitudinally central axis of said door hinge.

13. The door privacy screen of claim 12, wherein said arcuate portion extends through an arc of substantially 180°.

* * * * *